US010703091B2

(12) United States Patent
Yamasaki

(10) Patent No.: US 10,703,091 B2
(45) Date of Patent: Jul. 7, 2020

(54) PRINTING MACHINE HAVING DUCTOR ROLLER, CORRECTION DEVICE, AND PRINTING MACHINE CORRECTION METHOD

(71) Applicant: I.MER CO., LTD., Kyoto-shi (JP)

(72) Inventor: Kenjiro Yamasaki, Kyoto (JP)

(73) Assignee: I.MER CO., LTD., Kyoto (JP)

( * ) Notice: Subject to any disclaimer, the term of this patent is extended or adjusted under 35 U.S.C. 154(b) by 154 days.

(21) Appl. No.: 16/072,234

(22) PCT Filed: Jun. 15, 2017

(86) PCT No.: PCT/JP2017/022038
§ 371 (c)(1),
(2) Date: Jul. 24, 2018

(87) PCT Pub. No.: WO2018/025514
PCT Pub. Date: Feb. 8, 2018

(65) Prior Publication Data

US 2019/0030881 A1 Jan. 31, 2019

(30) Foreign Application Priority Data

Aug. 1, 2016 (JP) ..... 2016-150993

(51) Int. Cl.

| | |
|---|---|
| ***B41F 33/00*** | (2006.01) |
| ***B41F 31/02*** | (2006.01) |
| ***B41F 31/12*** | (2006.01) |
| ***B41F 31/14*** | (2006.01) |
| ***B41F 31/32*** | (2006.01) |

(52) U.S. Cl.
CPC ..... *B41F 33/0045* (2013.01); *B41F 31/022* (2013.01); *B41F 31/12* (2013.01); *B41F 31/14* (2013.01); *B41F 31/32* (2013.01); *B41P 2231/10* (2013.01)

(58) Field of Classification Search
CPC ..... B41F 33/0045
USPC ..... 101/484
See application file for complete search history.

(56) References Cited

U.S. PATENT DOCUMENTS 5,835,626 A 11/1998 Huber et al.
6,453,812 B1 * 9/2002 Ikeda ..... B41F 31/045 101/365
6,481,352 B2 * 11/2002 Mayer ..... B41F 31/00 101/350.3

(Continued)

FOREIGN PATENT DOCUMENTS

JP 2008318617 A 12/1996
JP 2010128956 A 5/1998

(Continued)

*Primary Examiner* — Anthony H Nguyen
(74) *Attorney, Agent, or Firm* — The Webb Law Firm

(57) ABSTRACT

A printing machine has an ink fountain, a fountain roller in contact with the ink fountain, a ductor roller, at least an ink transfer roller and a controller configured and programmed to control the ductor roller. For the printing machine, individual graph data gr and its initial values gri, and average g of the graph data over the entire ductor roller and its initial value gi are used to change graph data gr and g during printing so as to cancel errors between measured printed densities and desired printed densities. An adjustment apparatus and method also achieve this task for such a printing machine.

7 Claims, 7 Drawing Sheets

(56) References Cited

U.S. PATENT DOCUMENTS

| | | | | |
|---|---|---|---|---|
| 9,446,581 | B2 | 9/2016 | Yamasaki | |
| 2001/0042483 | A1* | 11/2001 | Komori | H04N 1/6055 101/484 |
| 2006/0000375 | A1* | 1/2006 | Hino | B41F 31/14 101/350.3 |
| 2008/0105148 | A1* | 5/2008 | Kusaka | B41F 31/12 101/363 |
| 2011/0032289 | A1* | 2/2011 | Hirano | B41F 33/0045 347/7 |
| 2011/0132221 | A1* | 6/2011 | Hartmann | B41F 33/0036 101/484 |
| 2011/0205276 | A1* | 8/2011 | Shibata | B41J 2/2135 347/14 |
| 2014/0111594 | A1* | 4/2014 | Schuh | B41J 3/36 347/218 |
| 2015/0266298 | A1* | 9/2015 | Kifuku | B41J 2/16526 347/9 |

FOREIGN PATENT DOCUMENTS

| | | | |
|---|---|---|---|
| JP | 2000108308 | A | 4/2000 |
| JP | 2015063071 | A | 4/2015 |

* cited by examiner

| File | | |
|---|---|---|
| g | gi (initial) | ge (final) |
| gr(roller 1) | gri | gre |
| gr(roller 2) | gri | gre |
| gr(roller 3) | gri | gre |
| • • • | | |
| Printing speed | | |

PRINTING MACHINE HAVING DUCTOR ROLLER, CORRECTION DEVICE, AND PRINTING MACHINE CORRECTION METHOD

This application is the United States national phase of International Application No. PCT/JP2017/022038 filed Jun. 15, 2017, and claims priority to Japanese Patent Application No. 2016-150993 filed Aug. 1, 2016, the disclosures of which are hereby incorporated in their entirety by reference.

FIELD OF THE INVENTION

The present invention relates to a printing machine having a ductor roller.

BACKGROUND ART

In printing machines having a ductor roller, the ductor roller is provided between a fountain roller and an ink transfer roller. The ductor roller is a roller divided into multiple individual rollers along its axis, and the duty ratio at which the individual rollers contact on the fountain roller is controllable independently for the individual rollers. Further, the printed density on the printed product is measured for each color component, and the individual rollers in the ductor roller are feedback controlled so that the printed density is in agreement with the desired density. With the feedback control, the variations in printed density during printing is reduced (Patent Document 1: JP 2015-63071A, corresponding to U.S. Pat. No. 9,446,581).

The ductor roller has an amount of ink drawn from the fountain roller, and ink transfer rollers also have an amount of ink. Because of the ink reservation on the rollers, the control of printed density by means of the ductor roller has a delay time. To reduce the delay time, it has been proposed to increase temporarily the amount of ink feeding to the ductor roller when the printing plate is exchanged and the new image area ratio in the new printing plate is increased, and also to decrease temporarily ink feeding amount to the ductor roller when the new image area ratio is decreased (Patent Document 1: JP 2015-63071A, corresponding to U.S. Pat. No. 9,446,581).

CITATION LIST

Patent Document

Patent Document 1: JP 2015-63071A, corresponding to U.S. Pat. No. 9,446,581

SUMMARY OF THE INVENTION

Problems to be Solved by the Invention

The control data of the ductor roller is made optimistic with monitoring the printed density and feeding back it to the ductor roller. However, it has not been considered in the conventional art how to utilize the resultant control data of the ductor roller to improve printing quality on the next or a subsequent day. For instance, when the same printing plate is to be used on the next day, the data which is resultant today will be also usable on the next day. However, this is a rare case, and when a new printing plate is to be used for printing on the next day, it has not been considered how the old control data resultant till the previous day may be utilized in the subsequent day.

Since old data for an old printing plate may not be utilized, for each exchange of printing plate, it is necessary to monitor printed density and to wait until the printing conditions reach within an allowable range. This increases loss papers before the printed density reaches within an allowable range. Further, since inexperienced operators generate more loss papers, printing jobs have to depend heavily upon experienced operators.

The object of the invention is to adjust control data for the ductor roller with learning by an adjustment apparatus so as to decrease losses such as loss papers at the start of printing jobs;

improve printing quality;

compensate the variations in printing machine's condition; and reduce dependency upon experienced operators.

Means for Solving the Problem

The printing machine according to the present invention has a ductor roller and comprises an ink fountain, a fountain roller in contact with the ink fountain, the ductor roller, at least an ink transfer roller, and a controller configured and programmed to control the ductor roller.

Said ductor roller is provided with multiple individual rollers arranged along an axis direction of the ductor roller.

The time durations during which the individual rollers are in contact with the fountain roller are referred to as contact time $\tau$; a period for controlling the individual rollers between positions in contact with and not in contact with the fountain roller is referred to as a control period T1; and said controller is configured and programmed to control individually duty ratios of the individual rollers, said duty ratios consisting of ratios $\tau$/T1 of the contact time to the control period, in order to control individually ink feeding amounts by the individual rollers.

Parameters for the individual rollers indicating desired ink feeding amounts by the individual rollers are referred to as individual graph data gr; initial values of the individual graph data gr are referred to as gri and are determined according to images to be printed; an average of the individual graph data gr over the whole of the ductor roller is referred to as an averaged graph data g; and an initial value of the averaged graph data g is referred to as gi. Said controller is configured and programmed to control the duty ratios of the individual rollers based upon the individual graph data gr and to change the individual graph data gr so as to cancel errors between measured printed densities and desired printed densities or according to an input by an operator.

The printing machine is further provided with an adjustment apparatus for adjusting said duty ratios.

The adjustment apparatus is configured and programmed:

wherein a stable value of the averaged graph data g is referred to as ge and stable values of the individual graph data gr are referred to as gre;

to collect data including the initial value gi and the stable value ge both of the averaged graph data g, and the initial values gri and the stable values gre both of the individual graph data gr;

to update a basic parameter B based upon a difference between a distribution of the stable values ge and a distribution of the initial values gi both of the averaged graph data in the collected data;

wherein the collected data are classified into multiple printing speed regions according to printing speeds;

to update individually speed parameters V which are parameters in the individual printing speed regions, based upon differences between distributions of the stable values ge and distributions of the initial values gi both of the averaged graph data in the individual printing speed regions;

wherein the collected data are classified into multiple regions according to the averaged graph data g;

to update individually area parameters F which are parameters in the individual regions according to the averaged graph data g, based upon differences between distributions of the stable values ge and distributions of the initial values gi in the individual regions according to the averaged graph data g;

to process the collected data individually for the individual rollers and to update individually roller parameters R which are parameters for the individual rollers, based upon differences between distributions of the stable values gre and distributions of the initial values gri both of the individual graph data;

to change collectively the duty ratios of the individual rollers, based upon three parameters of the updated basic parameter B, an updated speed parameter V corresponding to a printing speed for a present printing job, and an updated area parameter F corresponding to an averaged graph data in the present printing job; and to change individually the duty ratios of the individual rollers, based upon the updated roller parameters R corresponding to the individual rollers.

The adjustment apparatus for a printing machine and the adjustment method both according to the present invention adjust the below described duty ratios of a printing machine having a ductor roller and comprising an ink fountain, a fountain roller in contact with the ink fountain, the ductor roller, at least an ink transfer roller, and a controller configured and programmed to control the ductor roller, wherein said ductor roller is provided with multiple individual rollers arranged along an axis direction of the ductor roller, wherein time durations during which the individual rollers are in contact with the fountain roller are referred to as contact time $\tau$, a period for controlling the individual rollers between positions in contact with and not in contact with the fountain roller is referred to as a control period T1, and wherein said controller is configured and programmed to control individually duty ratios of the individual rollers, said duty ratios consisting of ratios $\tau$/T1 of the contact time to the control period, in order to control individually ink feeding amounts by the individual rollers;

wherein parameters for the individual rollers indicating desired ink feeding amounts by the individual rollers are referred to as individual graph data gr, initial values of the individual graph data gr are referred to as gri and are determined according to images to be printed, an average of the individual graph data gr over the whole of the ductor roller is referred to as an averaged graph data g, and an initial value of the averaged graph data g is referred to as gi, wherein said controller is configured and programmed to control the duty ratios of the individual rollers based upon the individual graph data gr and to change the individual graph data gr so as to cancel errors between measured printed densities and desired printed densities or according to an input by an operator.

According to the invention, the adjustment apparatus carries out the following steps:

wherein a stable value of the averaged graph data g is referred to as ge and stable values of the individual graph data gr are referred to as gre;

collecting data including the initial value gi and the stable value ge both of the averaged graph data g, and the initial values gri and the stable values gre both of the individual graph data gr;

updating a basic parameter B based upon a difference between a distribution of the stable values ge and a distribution of the initial values gi both of the averaged graph data in the collected data;

classifying the collected data into multiple printing speed regions according to printing speeds;

updating individually the speed parameters V which are parameters in the individual printing speed regions, based upon differences between distributions of the stable values ge and distributions of the initial values gi both of the averaged graph data in the individual printing speed regions;

classifying the collected data into multiple regions according to the averaged graph data g;

updating individually area parameters F which are parameters in the individual regions according to the averaged graph data g, based upon differences between distributions of the stable values ge and distributions of the initial values gi in the individual regions according to the averaged graph data g;

processing the collected data individually for the individual rollers and individually updating roller parameters R which are parameters for the individual rollers, based upon differences between distributions of the stable values gre and distributions of the initial values gri both of the individual graph data;

changing collectively the duty ratios of the individual rollers based upon three parameters of the updated basic parameter B, an updated speed parameter V corresponding to a printing speed for a present printing job, and an updated area parameter F corresponding to an averaged graph data in the present printing job; and changing individually the duty ratios of the individual rollers based upon the updated roller parameters R corresponding to the individual rollers.

According to the invention, the following functions and advantageous merits are resultant:

1) According to the basic parameter B, the overall errors, which are caused by the influence of inks and conditions of the printing machine and are independent of the printing speeds, the image area ratios, and the individual rollers, are adjusted.
2) According to the speed parameters V, errors dependent upon printing speeds are adjusted.
3) According to the area parameters F, errors dependent upon image area ratios are adjusted.
4) According to the roller parameters R, errors in the individual rollers are adjusted.
5) With these parameters, changes in the conditions of the printing machine are adjusted and printing jobs may start from nearly adequate duty ratios.
6) Since the printing jobs are started from the nearly adequate duty ratios, the loss papers are reduced, and, without experienced operators, high quality printing may be performed.
7) When printing on cans and CD-ROMs instead of papers, losses until the printed density becomes stable are reduced.

The basic parameter B is applied to all the individual rollers. With respect to the area parameters F, the parameter in the region to which the averaged graph data for the present printing job belongs to is applied. With respect to the speed parameters V, the parameter in the region to which the printing speed for the present printing job belongs to is applied. The roller parameters R are parameters provided separately for the individual rollers. The stable values gre of the individual graph data gr are measured for example simultaneously with the stable value ge of the averaged graph data g. In the specification, descriptions about the printing machine are applicable to the adjustment apparatus and to the adjustment method as they are. The differences between the distribution of the stable values and the distribution of the initial values are intended to mean the differences between the average of the stable values and the average of the initial values, the differences between the median of the stable values and the median of the initial values, and so on. The difference between the distributions may be dealt with simply as the difference in the averages or the ratio of the averages, and the difference in the averages and the ratio of the averages represent substantially the same factor.

Preferably, the adjustment apparatus is configured and programmed:

to increase the basic parameter B when an average of the difference ge−gi between the stable value and the initial value both of the averaged graph data is positive, and to decrease the basic parameter B when the average of the difference ge−gi between the stable value and the initial value both of the averaged graph data is negative;

to increase individually the speed parameters V when the averages of the differences ge−gi between the stable values and the initial values both of the averaged graph data are positive in the individual regions of the printing speeds, and to decrease individually the speed parameters V when the averages of the differences ge−gi between the stable values and the initial values of the averaged graph data are negative in the individual regions of the printing speeds, wherein the speed parameters V indicate parameters in the individual printing speed regions, when the collected data are classified into the printing speed regions according to printing speeds;

to increase individually the area parameters F when averages of the differences ge−gi between the stable values and the initial values both of the averaged graph data are positive in the individual regions of the averaged graph data g, and to decrease individually the area parameters F when the averages of the differences between the stable values of the averaged graph data and the initial values of the averaged graph data ge−gi are negative in the individual regions of the averaged graph data g, with respect to the area parameters F for the individual regions of the averaged graph data g into which the collected data are classified;

to process individually the collected data for the individual rollers and to increase individually the roller parameters R when averages of differences gre−gri between the stable values and the initial values both of the individual graph data are positive and to decrease individually the roller parameters R when the averages of differences gre−gri between the stable values and the initial values both of the individual graph data are negative, with respect to the roller parameters R for the individual rollers;

to increase the duty ratios of all the individual rollers when three parameters of the updated basic parameter B, an updated speed parameter F corresponding to the printing speed for a present printing job, and an updated area parameter F corresponding to an averaged graph data g in the present printing job are larger than 1 and to decrease the duty ratios of all the individual rollers when all of said three parameters are smaller than 1; and to increase individually the duty ratios of the individual rollers when the updated roller parameters R for the individual rollers are larger than 1 and to decrease individually the duty ratios of the individual rollers when the updated roller parameters are smaller than 1.

When two of the basic parameter B, the speed parameter V, and the area parameter F are larger than 1 and the remaining one parameter is smaller than 1, or when a similar situation has occurred, the duty ratio is controlled by a majority rule among the B,V,F. For example, the product (B·V·F) of the three parameters is compared with 1, and when the product (B·V·F) is larger than 1, the duty ratios of all the individual rollers are increased. When the product (B·V·F) is smaller than 1, the duty ratios of all the individual rollers are decreased. Further, the positive or the negative of ge−gi indicates the same thing to whether ge/gi is larger than 1 and to whether gi/ge is smaller than 1. The average is one resultant over the collected data, and to get the average, every data may be used or some unreliable data deviated from the center of the data distribution may be excluded. Further, with respect to the update of the speed parameters V, the collected data are sorted into the regions according to printing speeds, and with respect to the update of the area parameters F, the collected data are sorted into the regions according to averaged graph data. The initial values gri of the individual rollers may be determined according to the image to be printed such that the initial values gri are determined according to image area ratios with respect to the individual ductor rollers, for example.

Preferably, said adjustment apparatus is configured and programmed with respect to the three parameters of the basic parameter B, the speed parameters V, and the roller parameters R, to evaluate only the collected data where the averaged graph data g is not less than a first predetermined value and not to evaluate the collected data where the averaged graph data g is less than the first predetermined value; and with respect to the area parameters F, to evaluate both the collected data where the averaged graph data g is not less than the first predetermined value and the collected data where the averaged graph data g is less than the first predetermined value. When the averaged graph data is small, the printed density may be unstable; therefore, only the data where the graph data is equal to or larger than the predetermined value are used in such a way that the basic parameter B, the speed parameters V, and the roller parameters R are altered in a highly reliable manner. On the contrary, with respect to the area parameters which should cover a wide range of the graph data regions, the data where the graph data is less than the predetermined value are also evaluated.

Preferably, said adjustment apparatus is configured and programmed to update four parameters of the basic parameter B, the speed parameters V, the area parameters F, and the roller parameters R to cancel only partly the differences between the distributions of the stable values ge and the distributions of the initial values gi both of the averaged graph data or to cancel only partly the differences between the distributions of the stable values gre and the distributions of the initial values gri both of the individual graph data. With the iterative updates of the adjustment parameters, the parameters approach to the optimistic values asymptotically and do not oscillate.

Preferably, said adjustment apparatus is configured and programmed to adjust the graph data ge, gi, gre, or gri when changing one parameter of the basic parameter B, the speed parameters V, the area parameters F, and the roller parameters R so as to adjust influence by the change in said one parameter, and to adjust other parameters based upon the adjusted graph data ge, gi, gre, or gri. In this algorithm, since errors already treated by other parameters are not treated once more by another parameter, over adjustments do not occur.

PREFERRED EMBODIMENT FOR CARRYING OUT THE INVENTION

The best embodiment for carrying out the invention will be described in the following. The embodiment does not restrict the scope of the invention. The scope of the invention is determined according to accompanying claims in consideration with well-known matters in the art and in consideration with construction by an ordinary person in the art.

Embodiment

Figure 1:
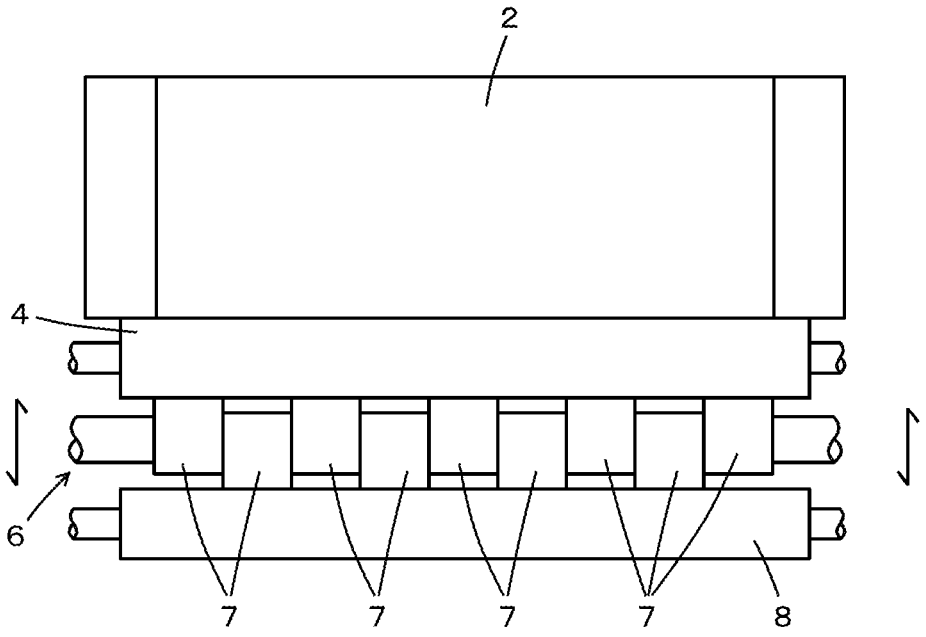
FIG. 1 A plan view indicating an ink fountain, a fountain roller, a ductor roller, and an ink transfer roller FIG. 2 A waveform diagram indicating a control waveform for the ductor roller FIG. 3 A block diagram of a printing machine according to one embodiment FIG. 4 A schematical view indicating a graph data file FIG. 5 A block diagram indicating an adjustment apparatus according to the embodiment and print units around the adjustment apparatus FIG. 6 A flow chart indicating the update algorithm of basic parameter according to the embodiment FIG. 7 A flow chart indicating the update algorithm of speed parameters according to the embodiment FIG. 8 A flow chart indicating the update algorithm of image area parameters according to the embodiment FIG. 9 A flow chart indicating the update algorithm of roller parameters according to the embodiment

FIGS. 1 to 9 show an adjustment apparatus 20 according to the embodiment and the adjustment method according to the embodiment. As indicated in FIG. 1, an ink fountain 2 reserves ink, a fountain roller 4 is in contact with the ink fountain 2, and a ductor roller 6 draws the ink from the fountain roller 4. The ductor roller 6 comprises multiple individual rollers 7; the rollers 7 advance and retract along an arrowed direction in FIG. 1 between positions in contact with the fountain roller 4 and positions not in contact with the fountain roller and are controlled individually. In this specification, "the ductor roller 6" indicates the whole of multiple rollers 7, and the "roller 7" or the "rollers 7" indicate an individual roller 7 or the individual rollers. Multiple ink transfer rollers 8 are provided, and one of them is indicated in the drawing. The ink transfer rollers 8 knead the ink and supply the ink to a plate cylinder.

Figure 2:
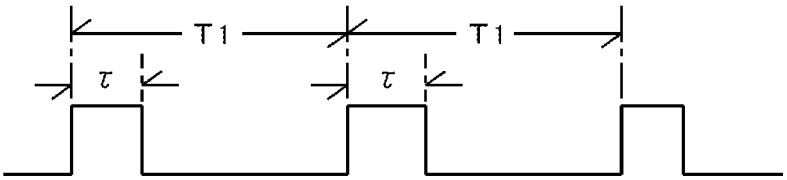

FIG. 2 indicate a control waveform for the rollers 7; the rollers 7 advance and retract between positions in contact with the fountain roller 4 (on positions) and positions not in contact with the fountain roller 4 (off positions) for instance pneumatically. Indicated by T1 is the control period for the rollers 7, by ti is an on time (the contact time with the fountain roller), and the on time is controlled so that ink feeding amounts by individual rollers 7 are controlled. It is arbitrary whether to fix the period T1 and to control τ, to fix τ and to control the period T1, or to control both ti and the period T1. The rollers 7 draw the ink from the fountain roller 4; the ink feeding amounts are controlled by controlling the duty ratios (the ratios τ/T1 of the contact time to the control period).

Figures 3, 4:
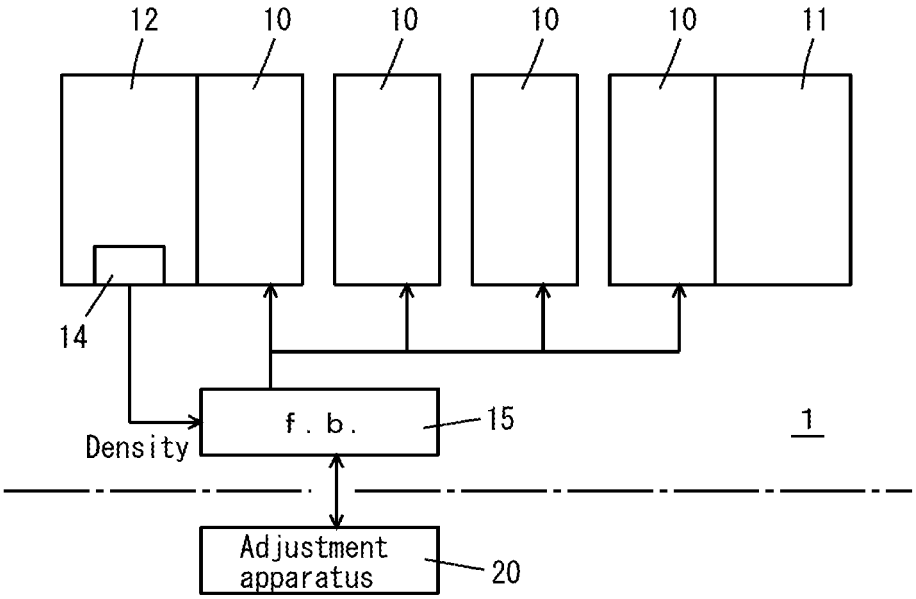

FIG. 3 indicates a printing machine that is provided with multiple print units 10 (hereinafter referred to as "unit 10") for individual colors of ink such as those in CMYK, and a sheet feeder 11 and a sheet delivery 12 in addition. A densitometer 14 provided in the sheet delivery 12 for example, monitors the printed density on printing sheets. The printed density is measured individually for positions corresponding to the individual rollers 7 and is inputted into a feedback apparatus 15, and the amount of ink feeding by each roller 7 is individually controlled by the control of the contact time τ. Meanwhile, graph data changes. The species of the printing machine 1 is arbitrary, and the units 10 may be inkers in printing machines for cans, and so on. Further, printing machines without the densitometer are usable when an operator adjusts individual graph data gr with monitoring the printed densities. In this case, a control apparatus for the duty ratios in place of the feedback apparatus 15 is provided, and the operator inputs the individual graph data gr into the control apparatus so that actual printed density agrees with a desired printed density.

An adjustment apparatus 20 outputs adjustment parameters to the feedback apparatus 15. The adjustment parameters comprise four species of parameters: a basic parameter B for adjustment of variations in printed density (hereinafter referred to as "density") according to the species of the ink and the conditions of the unit 10; speed parameters V for adjustment of variations in density according to printing speeds; area parameters F for adjustment of variations in density according to the values of the graph data; and roller parameters R for adjustment of variations in density according to the conditions of individual rollers 7. Further, other parameters, such as one for dealing with the properties of printing sheets, may be added. These parameters are dependent upon and meaningful for the combination of unit 10, the printing sheets, and the ink. When one combination has been used in a printing job in the past, the initial values for the parameters B, V, F, R may be determined according to the graph data in the past printing job. When the combination is new and has not been used in the past, the initial values for the parameters B, V, F, R may be set one, or parameters B, V, F, R resultant in a similar combination may be used as the initial values for the parameters B, V, F, R.

The exchange of a roller, cleaning of the water tank, and so on influence greatly the conditions of the print unit 10. When the conditions of the print unit 10 have greatly changed, it is advantageous to initialize the parameters B, V, F, R.

FIG. 4 indicates a graph data file schematically. The graph data specifies the amount of ink to be drawn by the ductor roller (the desired ink feeding amount). When a printing plate is determined, namely, when an image to be printed is determined, the image area ratios of the printing plate determine individually the graph data gr for the individual rollers 7. The graph data gr indicate the desired amounts of ink to be drawn and are present for individual inks such as CMYK. The graph data file stores an averaged graph data g over the entire ductor roller, individual graph data gr for the individual rollers, the printing speed, and so on. Further, as the graph data g, gr, the file stores the startup values (initial values) gi, gri determined according to the image area ratios, and also their stable values ge, gre after the feedback control. The values ge, gre are gotten when the printed density has approached the desired value and therefore has become stable; for instance, they are the graph data gotten during the second half of a printing job. The values ge, gre may be called graph data at the end of a printing job. The graph data files are produced during printing jobs for each printing plate.

Figure 5:
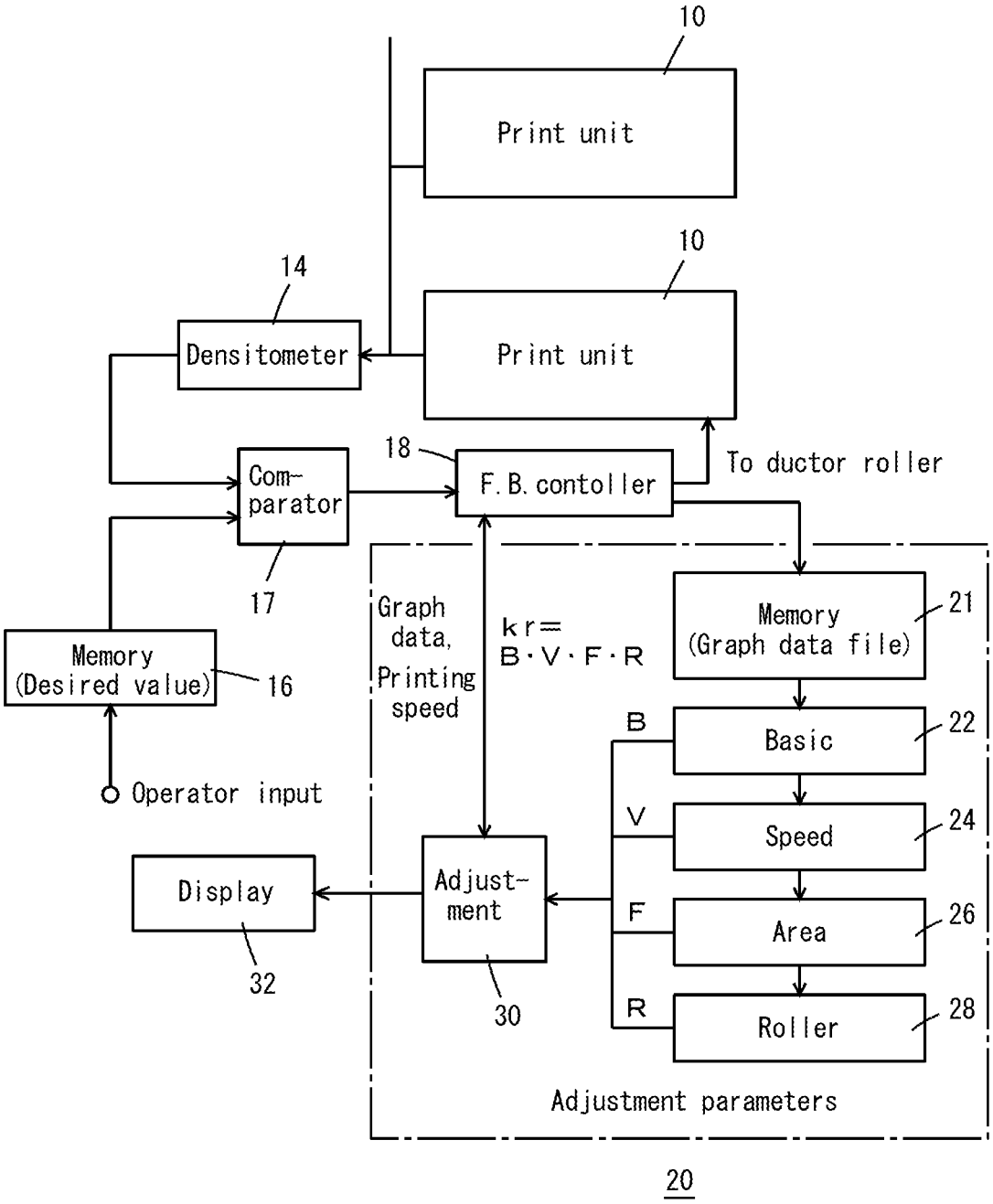
Figure 6:
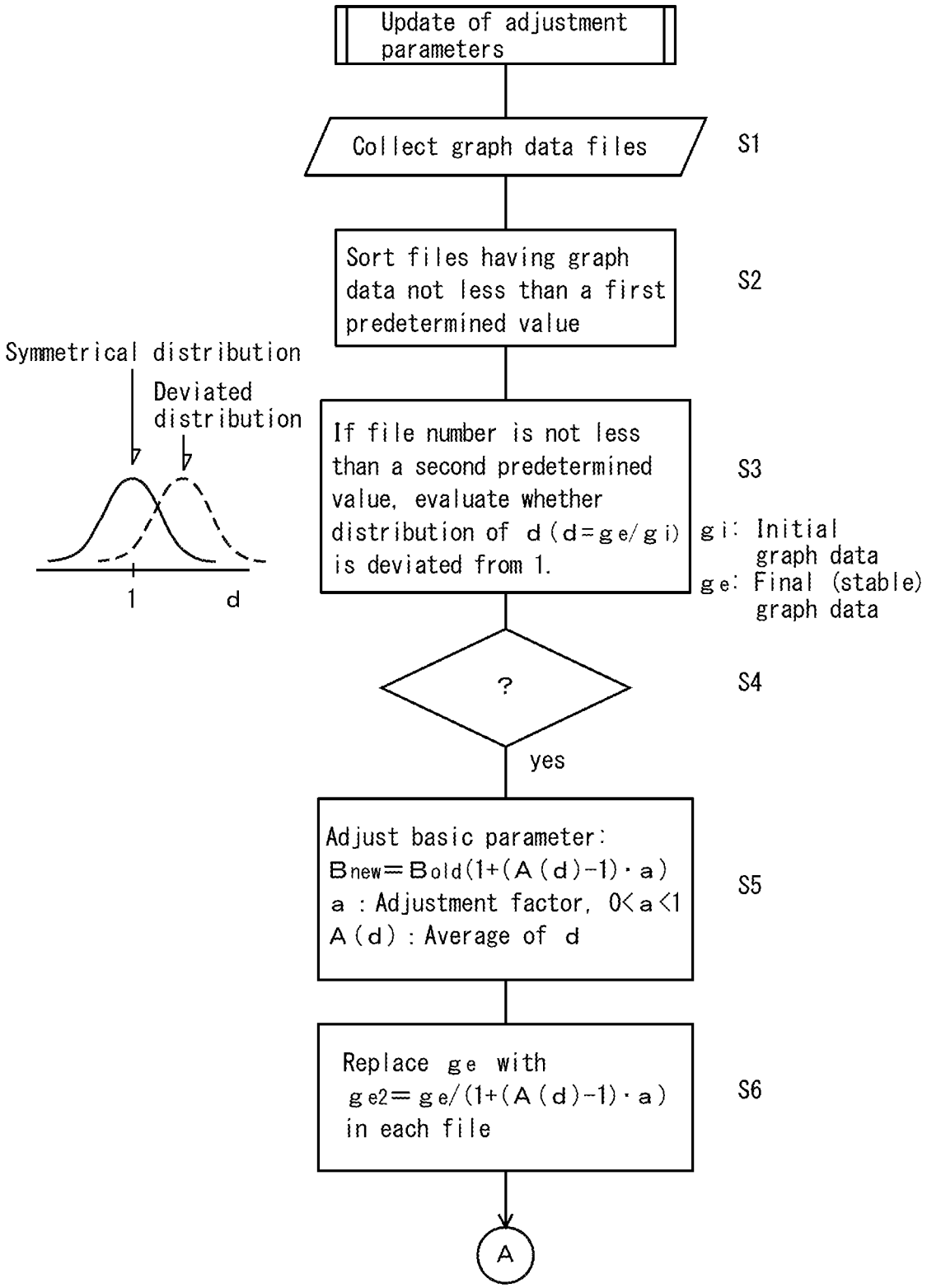

FIG. 5 indicates the adjustment apparatus 20. The printed density is monitored by the densitometer 14 and is compared by a comparator 17 with the desired value for the printed density stored in a memory 16 (for instance, inputted value by the operator), and a feedback controller 18 controls the ductor roller with adjusted graph data g, gr so that the error in the printed density is cancelled. The feedback apparatus 15 in FIG. 3 comprises the memory 16, the comparator 17, and the controller 18.

The adjustment apparatus 20 consists of an adequate computer and is a part of the printing machine 1. However, when a host computer controls multiple printing machines via LAN, the adjustment apparatus 20 may be provided within the host computer. The adjustment apparatus 20 monitors the changes in the graph data in the controller 18 and makes a memory 21 to store the graph data files in FIG. 4.

The adjustment apparatus 20 updates the adjustment parameters, for example, when ending one day's printing jobs, and stores the transitions of the adjustment parameters' values (for example, the initial and the present values). Changes in the conditions of the print unit 10 cause the update of the adjustment parameters. The accumulated values of the changes in the adjustment parameters indicate the changes in the conditions of the print unit 10. Therefore, the accumulated values of the changes in the adjustment parameters are advantageously indicated on the display 32 so that the operator may notice the changes in the conditions of the print unit 10.

Update means for the basic parameter is indicated 22; update means for speed parameters is indicated 24; update means for area parameters is indicated 26, and update means for roller parameters is indicated 28. An adjustment means 30 inputs the updated parameters to the controller 18, and the controller 18 adjusts the duty ratios for the "on" for the individual rollers 7 according to the product kr of these parameters.

FIGS. 6 to 9 indicate the update algorithm of the parameters. In the step 1 in FIG. 6, the graph data files are collected; namely, the files are stored in the memory 21. First, the basic parameter which reflects the species of the ink and the conditions of the unit 10 is updated. When the graph data is less than a first predetermined value, the printed density may be unstable, and therefore, those graph data files where the graph data are not less than the first predetermined value are sorted (step 2). Here, the graph data may be the initial values gi (startup values) or the stable values ge (stable values before ending printing jobs).

The number of sorted files is confirmed not less than a second predetermined value (for example 2). Further, it is confirmed that the distribution of d (d=ge/gi) is not symmetrical around 1 and deviated from 1 to the area where d is larger than 1 or to the area where d is smaller than 1 (steps 3,4). The factor d indicates the degree of adjustment to the graph data at the startup (graph data when printing jobs started) by the feedback apparatus 15; when d>1, the graph data has been increased, and when d<1, the graph data has been decreased. Further, individual d values exist for the individual files. When the file number is small, the reliability of the data is low, and when the distribution of d is symmetrical around 1, the update of the basic parameter is not needed. However, the confirmation that the distribution of d is not symmetrical around 1 may be omitted.

When there are multiple files whose graph data are not less than the first predetermined value, and when the distributions of d in the files are deviated from 1 to the area where d is larger than 1 or to the area where d is smaller than 1, the basic parameter B is updated. The new basic parameter is set using the average A(d) of d, $$Bnew=\text{Bold}\times(1+(A(d)-1)a) \quad \text{(step 5).}$$

Here, "a" is an adjustment factor and 0<a<1, "Bold" is the basic parameter before the update, and "Bnew" is the basic parameter after the update. Instead of canceling completely the error in the basic parameter B, the error is partly removed for each update so that the basic parameter B reaches asymptotically an adequate value through iterative updates. The change by one update is determined by (A(d)−1) a, and there may be an upper limit for the absolute value of (A(d)−1) a. After B is updated, as a preparation for updating other parameters, such as the speed parameters, with respect to the graph data where B has been updated, the value of ge is replaced with $$ge2=ge/(1+(A(d)-1)a) \quad \text{(step 6).}$$

Figure 7:
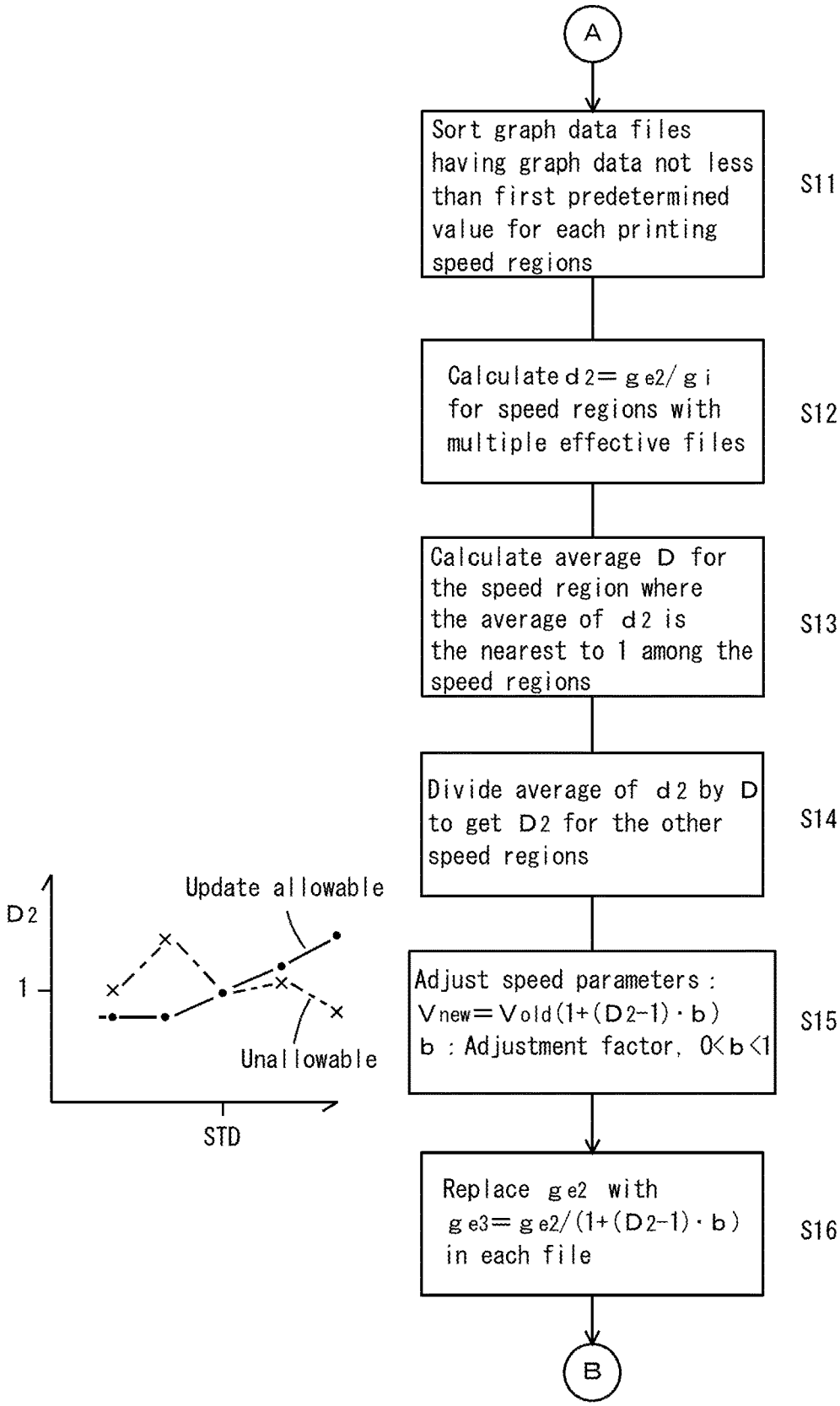

FIG. 7 indicates the update of the speed parameters V; the files where the graph data are not less than the first predetermined value are collected. In other words, those files whose graph data is too low and therefore may make printed density unstable are excluded. The collected files of the graph data are sorted according to the regions of printing speeds (step 11). For each speed region where multiple effective files (files where the graph data are not less than the first predetermined value) are present, d2=ge2/gi is calculated for each file (step 12), and the average of d2 within each speed region is calculated. The nearest to 1 in the averages of d2 for individual speed regions is set D. The speed region to which D belongs is made the standard speed region, in the standard speed region, the speed parameter is not updated, and, in the other speed regions, the average is divided by D to D2 (step 14). Here, it is supposed that, in the updates according to the speed regions, the change due to the update should be 0 for a certain region. However, this supposition may be omitted. Further, the limitation that D2 should change smoothly is added; the update starts from the standard speed region, and there is set the limitation that the value of D2 should be an intermediate value between the values in the left and right adjacent speed regions. If the limitation is not satisfied, for the region where the limitation is not satisfied, D2 is made to 1 (D2=1).

The speed parameters are updated in a similar way to the basic parameter B (step 15). A certain upper limit for the change due to the update may be provided. Further, for the next update of area parameters, the value of ge2 is replaced with $$ge3=ge2/(1+(D2-1)b) \quad \text{(step 16).}$$

Figure 8:
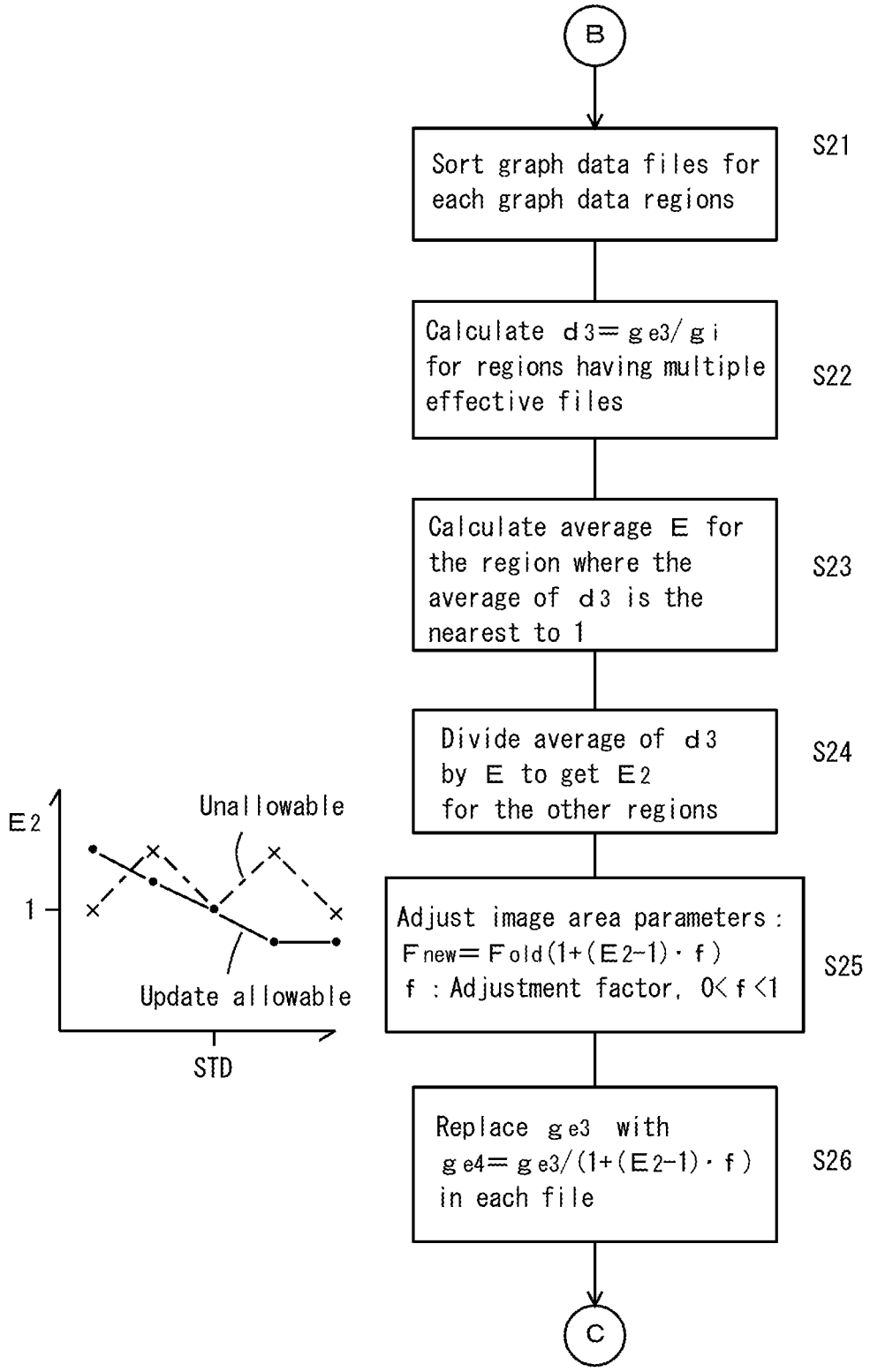

FIG. 8 indicates the update of area parameters F. With respect to the area parameters F, for updating parameters F over a wide range of the averaged graph data g, those files whose graph data are less than the first predetermined value are also used and included for the update. In the update, the area parameters are classified over a wide range of the graph data g into the regions of the averaged graph data g, files in each region (region of the graph data g) are sorted as effective files (step 21). With respect to the area regions (regions of the graph data g) where multiple effective files are present, the ratio d3=ge3/gi is calculated (step 22). The area region where the average of d3 is the nearest to 1 among the regions is selected, and the average of d3 in the selected region is set E. For normalizing by the standard value E, the averages in other area regions are divided by E to E2 (step 24). Further, in the area region corresponding to E, the parameter F is not updated. It is supposed that the change by the update should be 0 for a certain area region since the update is done for reflecting changes dependent upon the area regions (regions of the graph data). Further, it is supposed that E2 should smoothly change from 1 at the standard area region, and a value of E2 in one area region should be intermediate between the values of the two adjacent area regions. If this supposition is not satisfied, then, E2 is replaced with 1, for example.

In step 25, the area parameters F are updated in a similar way to the basic parameter B and so on. In step 26, as a preparation for the update of the roller parameters, ge3 is replaced with ge4 in such a way that ge4=ge3/(1+(E2−1)f). Further, with respect to the update of area parameters, when the insufficiency of the file number causes a delay of the update, the update may promptly be performed as if graph data files are present for the individual rollers 7.

The graph data files store the startup values gri of the graph data and the values gre at the end of a printing job for the individual rollers. When updating parameters B, V, F, the graph data gre are replaced in a similar way to the graph data ge in steps 6, 16, and 26 in FIGS. 6 to 8. By these replacements, the influence of the updates of the base parameter, speed parameters, and the area parameters is adjusted.

Figure 9:
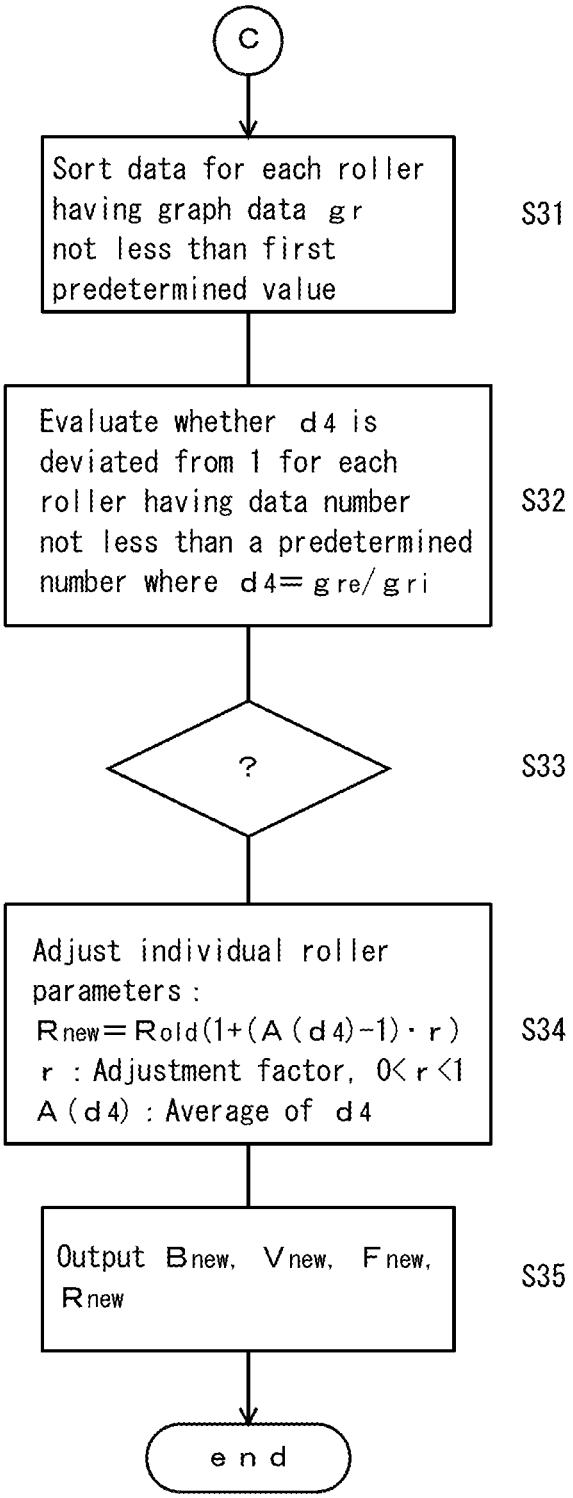

In FIG. 9, the parameter R for each roller is updated. In step 31, for each roller, the files where the graph data are not less than the first predetermined value are sorted. In step 32, it is checked whether the distribution of d4 deviates from 1, where d4=gre/gri (gre has already been replaced with new values in the steps 6, 16, 26). If the distribution deviates from 1 (step 33), the parameters for the individual rollers are updated in a similar way to the update of the basic parameter B (step 34). Then, the new parameters are outputted to the adjustment means 30 and are stored in the adjustment means (step 35). In the above process, the basic parameter B should be first updated, the roller parameters R should be last updated, but the order of the updates of the area parameters F and the speed parameters V is arbitrary.

According to the embodiment, the adjustment parameters are made optimized through the iterative updates. In other words, the updates are restricted by certain conditions so that the adjustment parameters do not oscillate due to an excessive update or due to an update based upon an unreliable data. For example, the following restrictions are applied:

the existence of multiple effective files;

usage of graph data not less than the first predetermined value (for the parameters B,V,R);

the adjustment factors between 0 and 1;

the upper limit for the absolute values of the changes by updates; and the smooth changes in the parameters according to the speed regions and area regions (for the parameters V, F). When oscillations of the parameters are acceptable, these restrictions may be omitted.

Among the conditions on the updates, for the updates of the basic parameter B, the speed parameters V, and the roller parameters R, it is important that files whose graph data are less than the first predetermined value should not be used. For the updates of the parameters B, V, F, R, it is important that, if there are not multiple effective files, the updates should not be done. Further, it is also important to make the parameters reach the optimistic values asymptotically through the multiple updates by restricting the adjustment factors between 0 and 1 or by setting the upper limits to the changes in the parameters.

Returning to FIG. 5, the adjustment of the duty ratios of the individual rollers will be described. The controller 18 stores the printing speed of the printing machine for the present job, and at least one of the image area ratio and the graph data g for the job. The adjustment means 30 selects an applicable speed region for the speed parameters V according to the printing speed of the printing machine for the current job and selects an applicable image area region (a region of the image area ratio or a region of the graph data) for the area parameters F according to the image area ratio or according to the graph data g for the present job. The adjustment means retrieves the applicable speed parameter V and the applicable area parameter F. Then, the adjustment means 30 multiplies B, V, F, R into the product kr=B·V·F·R and outputs kr into the controller 18. The controller 18 multiplies an individual duty ratio of an individual roller 7 determined by the graph data gr by kr so that the duty ratio is adjusted, and thus the individual roller 7 is controlled. By the way, in place of multiplying the duty ratio and kr, the initial value gri of gr may be multiplied by kr.

In the embodiment, while the four parameters are multiplied, it is enough if the adjustment factor for the duty ratio is determined by a function of the four parameters; the operation is not limited to multiplication. The four parameters may be updated independently; for example, without updating the area parameters F due to the lack of sufficient data, the other three parameters may be updated. When printing sheets are changed or when ink is changed, according to the embodiment, the adjustment parameters before the change is not used. However, the adjustment parameters before the change may still be used. For instance, the speed parameters V for adjusting the dependency on the speed of the printing machine and the roller parameters R adjusting the dependency upon individual rollers may be used without change from the previous parameters after changing the printing sheets or changing the ink.

According to the embodiment, the feedback apparatus 15 learns how the graph data have been altered and determines the adjustment parameters. According to the embodiment, the following advantageous merits are resultant:

1) According to the basic parameter B, the overall errors, which are caused by the influence of inks and conditions of the printing machine and are independent of the printing speeds, the image area ratios, and the individual rollers, are adjusted.
2) According to the speed parameters V, errors dependent upon printing speeds are adjusted.
3) According to the area parameters F, errors dependent upon image area ratios are adjusted.
4) According to the roller parameters R, errors in the individual rollers are adjusted.
5) With these parameters, changes in the conditions of the printing machine are adjusted and printing jobs may start from nearly adequate duty ratios.
6) Since the printing jobs are started from the nearly adequate duty ratios, the loss papers are reduced, and, without experienced operators, high quality printing may be performed;
7) When printing on cans and CD-ROMs instead of papers, losses until the printed density becomes stable are reduced; and
8) The adjustment parameters are updated so as to reach the optimistic values asymptotically and upon reliable data. Therefore, the adjustment parameters do not oscillate.

The parameters B, V, F, R are determined upon the combination of the print unit, the printing sheets, and the species of ink. There are some occasions that the graph data files in FIG. 4 have not been fully accumulated, when the print unit has been changed, when the printing sheets have been changed, or when the species of ink has been changed. It is described how to determine the initial values of parameter B, V, F, R in such cases. When the graph data files have not been accumulated enough, those parameters B, V, F, R that are for a similar print unit and for the same ink and for the same printing sheets;

those parameters B, V, F, R that are for printing sheets having a similar sheet properties and for the same ink and for the same printing unit; or those parameters B, V, F, R that are for a similar ink in the ink transfer property (a value indicating empirically the degree of the printed densities for the same ink feeding amount) and for the same print unit and for the same printing sheets, may be used as the initial values for the parameters B, V, F, R. Namely, when one factor of the three factors influencing the parameters B, V, F, R has been changed, parameters in the cases where the other two factors are the same may be set the initial values for the parameters.

Practically, special color inks other than CMYK are problematic. Due to the variety of them, it is difficult to determine adequate initial values of parameters B, V, F, R, and due to the low frequency of their use, it is not expectable for the parameters to be updated enough. Therefore, it is practical to use just preceding parameters V, F, R resultant from a different species of ink for the special color ink. The ink transfer properties for special color inks are often already evaluated empirically. A special ink parameter s is defined as an empirical value indicating the degree of increase in the ink feeding amount dependent upon the species of the ink, s=1 indicates a standard value, and it is assumed that, the larger the values of s, the larger the ink feeding amount is. A special ink parameters for a new special color ink and a special color ink parameter for another ink which was used just before are used. For instance, the basic parameter just before the ink change is referred to as B, the special ink parameter before the ink change is s', and the special ink parameter for the new special color ink is s, and s/s'×B may be used as the initial value of the basic parameter B for the new special color ink.

| DESCRIPTION OF SYMBOLS | |
|---|---|
| 1 | printing machine |
| 2 | ink fountain |
| 4 | fountain roller |
| 6 | ductor roller |
| 7 | roller |
| 8 | ink transfer roller |
| 10 | print unit |
| 11 | sheet feeder |
| 12 | sheet delivery |
| 14 | densitometer |
| 15 | feedback apparatus |
| 16 | memory |
| 17 | comparator |
| 18 | controller |
| 20 | adjustment apparatus |
| 21 | memory |
| 22 | update means for basic parameter |
| 24 | update means for speed parameters |
| 26 | update means for area parameters |
| 28 | update means for roller parameters |
| 30 | adjustment means |

-continued

| DESCRIPTION OF SYMBOLS | |
|---|---|
| 32 | display |
| T1: | Period |
| τ: | on time |
| g: | graph data |
| d, d2, d3, d4: | ratio of stable graph data to initial graph data |
| B: | basic parameter |
| V: | speed parameter |
| F: | area parameter |
| R: | roller parameter |
| A(d): | average of d |
| A(d4): | average of d4 |
| D2: | ratio of average of d2 within each speed region to average within the standard speed region |
| E2: | ratio of average of d3 within each graph data region to average within the standard graph data region |
| a, b, f, r: | adjustment factor |

The invention claimed is:

1. A printing machine having a ductor roller and comprising an ink fountain, a fountain roller in contact with the ink fountain, the ductor roller, at least an ink transfer roller, and a controller configured and programmed to control the ductor roller, wherein said ductor roller is provided with multiple individual rollers arranged along an axis direction of the ductor roller, wherein time durations during which the individual rollers are in contact with the fountain roller are referred to as contact time (τ), a period for controlling the individual rollers between positions in contact with and not in contact with the fountain roller is referred to as a control period (T1), and wherein said controller is configured and programmed to control individually duty ratios of the individual rollers, said duty ratios consisting of ratios (τ/T1) of the contact time to the control period, in order to control individually ink feeding amounts by the individual rollers;

wherein parameters for the individual rollers indicating desired ink feeding amounts by the individual rollers are referred to as individual graph data (gr), initial values of the individual graph data (gr) are referred to as (gri) and are determined according to images to be printed, an average of the individual graph data (gr) over the whole of the ductor roller is referred to as an averaged graph data (g), and an initial value of the averaged graph data (g) is referred to as (gi), wherein said controller is configured and programmed to control the duty ratios of the individual rollers based upon the individual graph data (gr) and to change the individual graph data (gr) so as to cancel errors between measured printed densities and desired printed densities or according to an input by an operator;

said printing machine is further provided with an adjustment apparatus for adjusting said duty ratios, wherein said adjustment apparatus is configured and programmed:

wherein a stable value of the averaged graph data (g) is referred to as (ge) and stable values of the individual graph data (gr) are referred to as (gre);

to collect data including the initial value (gi) and the stable value (ge) both of the averaged graph data (g), and the initial values (gri) and the stable values (gre) both of the individual graph data (gr);

to update a basic parameter (B) based upon a difference between a distribution of the stable values (ge) and a distribution of the initial values (gi) both of the averaged graph data in the collected data;

wherein the collected data are classified into multiple printing speed regions according to printing speeds;

to update individually speed parameters (V) which are parameters in the individual printing speed regions, based upon differences between distributions of the stable values (ge) and distributions of the initial values (gi) both of the averaged graph data in the individual printing speed regions;

wherein the collected data are classified into multiple regions according to the averaged graph data (g);

to update individually area parameters (F) which are parameters in the individual regions according to the averaged graph data (g), based upon differences between distributions of the stable values (ge) and distributions of the initial values (gi) in the individual regions according to the averaged graph data (g);

to process the collected data individually for the individual rollers and to update individually roller parameters (R) which are parameters for the individual rollers, based upon differences between distributions of the stable values (gre) and distributions of the initial values igrq both of the individual graph data;

to change collectively the duty ratios of the individual rollers based upon three parameters of the updated basic parameter (B), an updated speed parameter (V) corresponding to a printing speed for a present printing job, and an updated area parameter (F) corresponding to an averaged graph data in the present printing job; and to change individually the duty ratios of the individual rollers based upon the updated roller parameters (R) corresponding to the individual rollers.

2. The printing machine having a ductor roller according to the claim 1, said adjustment apparatus is configured and programmed:

with respect to the three parameters of the basic parameter (B), the speed parameters (V), and the roller parameters (R), to evaluate only the collected data where the averaged graph data (g) is not less than a first predetermined value and not to evaluate the collected data where the averaged graph data (g) is less than the first predetermined value; and with respect to the area parameters (F), to evaluate both the collected data where the averaged graph data (g) is not less than the first predetermined value and the collected data where the averaged graph data (g) is less than the first predetermined value.

3. The printing machine having a ductor roller according to claim 1, said adjustment apparatus is configured and programmed to update four parameters of the basic parameter (B), the speed parameters (V), the area parameters (F), and the roller parameters (R) to cancel only partly the differences between the distributions of the stable values (ge) and the distributions of the initial values (gi) both of the averaged graph data or to cancel only partly the differences between the distributions of the stable values (gre) and the distributions of the initial values (gri) both of the individual graph data.

4. The printing machine having a ductor roller according to claim 1, said adjustment apparatus is configured and programmed to adjust the graph data (ge) (gi), (gre), or (gri) when changing one parameter of the basic parameter (B), the speed parameters (V), the area parameters (F), and the roller parameters (B) so as to adjust influence by the change in said one parameter, and to adjust other parameters based upon the adjusted graph data (ge), (gi), (gre), or (gri).

5. The printing machine having a ductor roller according to claim 1, said adjustment apparatus is configured and programmed:

to increase the basic parameter (V) when an average of the difference (ge)-(gi) between the stable value and the initial value both of the averaged graph data is positive, and to decrease the basic parameter (B) when the average of the difference (ge)-(gi) between the stable value and the initial value both of the averaged graph data is negative;

to increase individually the speed parameters Oil when the averages of the differences (ge)-(gi) between the stable values and the initial values both of the averaged graph data are positive in the individual regions of the printing speeds, and to decrease individually the speed parameters (V) when the averages of the differences (ge)-(gi) between the stable values and the initial values of the averaged graph data are negative in the individual regions of the printing speeds, wherein the speed parameters Oil indicate parameters in the individual printing speed regions, when the collected data are classified into the printing speed regions according to printing speeds;

to increase individually the area parameters (F) when averages of the differences (ge)-(gi) between the stable values and the initial values both of the averaged graph data are positive in the individual regions of the averaged graph data (g), and to decrease individually the area parameters (F) when the averages of the differences between the stable values of the averaged graph data and the initial values of the averaged graph data (ge)-(gi) are negative in the individual regions of the averaged graph data (g), with respect to the area parameters (F) for the individual regions of the averaged graph data (g) into which the collected data are classified;

to process individually the collected data for the individual rollers and to increase individually the roller parameters (R) when averages of differences (gre)-(gri) between the stable values and the initial values both of the individual graph data are positive and to decrease individually the roller parameters (R) when the averages of differences (gre)-(gri) between the stable values and the initial values both of the individual graph data are negative, with respect to the roller parameters (R) for the individual rollers;

to increase the duty ratios of all the individual rollers when three parameters of the updated basic parameter (B), an updated speed parameter (F) corresponding to the printing speed for a present printing job, and an updated area parameter (F) corresponding to an averaged graph data (g) in the present printing job are larger than 1 and to decrease the duty ratios of all the individual rollers when all of said three parameters are smaller than 1; and to increase individually the duty ratios of the individual rollers when the updated roller parameters for the individual rollers are larger than 1 and to decrease individually the duty ratios of the individual rollers when the updated roller parameters for the individual rollers are smaller than 1.

6. An adjustment apparatus for a printing machine having a ductor roller and comprising an ink fountain, a fountain roller in contact with the ink fountain, the ductor roller, at least an ink transfer roller, and a controller configured and programmed to control the ductor roller, wherein said ductor roller is provided with multiple individual rollers arranged along an axis direction of the ductor roller, wherein time durations during which the individual rollers are in contact with the fountain roller are referred to as contact time (τ), a period for controlling the individual rollers between positions in contact with and not in contact with the fountain roller is referred to as a control period (T1), and wherein said controller is configured and programmed to control individually duty ratios of the individual rollers, said duty ratios consisting of ratios (τ/T1) of the contact time to the control period, in order to control individually ink feeding amounts by the individual rollers;

wherein parameters for the individual rollers indicating desired ink feeding amounts by the individual rollers are referred to as individual graph data (gr), initial values of the individual graph data (gr) are referred to as (gri) and are determined according to images to be printed, an average of the individual graph data (gr) over the whole of the ductor roller is referred to as an averaged graph data (g), and an initial value of the averaged graph data (g) is referred to as (gi), wherein said controller is configured and programmed to control the duty ratios of the individual rollers based upon the individual graph data (gr) and to change the individual graph data (gr) so as to cancel errors between measured printed densities and desired printed densities or according to an input by an operator;

said adjustment apparatus being configured and programmed for adjusting said duty ratios:

wherein a stable value of the averaged graph data (g) is referred to as (ge) and stable values of the individual graph data (gr) are referred to as (gre);

to collect data including the initial value (gi) and the stable value (ge) both of the averaged graph data (g), and the initial values (gri) and the stable values (gre) both of the individual graph data (gr);

to update a basic parameter (B) based upon a difference between a distribution of the stable values (ge) and a distribution of the initial values (gi) both of the averaged graph data in the collected data;

wherein the collected data are classified into multiple printing speed regions according to printing speeds;

to update individually speed parameters (V) which are parameters in the individual printing speed regions, based upon differences between distributions of the stable values (ge) and distributions of the initial values (gri) both of the averaged graph data in the individual printing speed regions;

wherein the collected data are classified into multiple regions according to the averaged graph data (g);

to update individually area parameters (F) which are parameters in the individual regions according to the averaged graph data (g), based upon differences between distributions of the stable values (ge) and distributions of the initial values (gi) in the individual regions according to the averaged graph data (g);

to process the collected data individually for the individual rollers and to update individually roller parameters (R) which are parameters for the individual rollers, based upon differences between distributions of the stable values (gre) and distributions of the initial values (gri) both of the individual graph data;

to change collectively the duty ratios of the individual rollers based upon three parameters of the updated basic parameter (B), an updated speed parameter (V) corresponding to a printing speed for a present printing job, and an updated area parameter (F) corresponding to an averaged graph data in the present printing job; and to change individually the duty ratios of the individual rollers based upon the updated roller parameters (R) corresponding to the individual rollers.

7. An adjustment method carried out by an adjustment apparatus for a printing machine having a ductor roller and comprising an ink fountain, a fountain roller in contact with the ink fountain, the ductor roller, at least an ink transfer roller, and a controller configured and programmed to control the ductor roller, wherein said ductor roller is provided with multiple individual rollers arranged along an axis direction of the ductor roller, wherein time durations during which the individual rollers are in contact with the fountain roller are referred to as contact time (τ), a period for controlling the individual rollers between positions in contact with and not in contact with the fountain roller is referred to as a control period (T1), and wherein said controller is configured and programmed to control individually duty ratios of the individual rollers, said duty ratios consisting of ratios (τ/T1) of the contact time to the control period, in order to control individually ink feeding amounts by the individual rollers;

wherein parameters for the individual rollers indicating desired ink feeding amounts by the individual rollers are referred to as individual graph data (gr), initial values of the individual graph data (gr) are referred to as (gri) and are determined according to images to be printed, an average of the individual graph data (gr) over the whole of the ductor roller is referred to as an averaged graph data (g), and an initial value of the averaged graph data (g) is referred to as (gi), wherein said controller is configured and programmed to control the duty ratios of the individual rollers based upon the individual graph data (gr) and to change the individual graph data (gr) so as to cancel errors between measured printed densities and desired printed densities or according to an input by an operator;

said adjustment method comprising following steps for adjusting said duty ratios:

wherein a stable value of the averaged graph data (g) is referred to as (ge) and stable values of the individual graph data (gr) are referred to as (gre);

collecting data including the initial value (gi) and the stable value (ge) both of the averaged graph data (g), and the initial values (gri) and the stable values (gre) both of the individual graph data (gr);

updating a basic parameter (B) based upon a difference between a distribution of the stable values (ge) and a distribution of the initial values (gi) both of the averaged graph data in the collected data;

classifying the collected data into multiple printing speed regions according to printing speeds;

updating individually the speed parameters (V) which are parameters in the individual printing speed regions, based upon differences between distributions of the stable values (ge) and distributions of the initial values (gi) both of the averaged graph data in the individual printing speed regions;

classifying the collected data into multiple regions according to the averaged graph data (g);

updating individually area parameters (F) which are parameters in the individual regions according to the averaged graph data (g), based upon differences between distributions of the stable values (ge) and distributions of the initial values (gi) in the individual regions according to the averaged graph data (g);

processing the collected data individually for the individual rollers and individually updating roller parameters (R) which are parameters for the individual rollers, based upon differences between distributions of the stable values (gre) and distributions of the initial values (gri) both of the individual graph data;

changing collectively the duty ratios of the individual rollers based upon three parameters of the updated basic parameter (B), an updated speed parameter (v) corresponding to a printing speed for a present printing job, and an updated area parameter (F) corresponding to an averaged graph data in the present printing job; and changing individually the duty ratios of the individual rollers based upon the updated roller parameters (R) corresponding to the individual rollers.

* * * * *